US007148884B2

(12) United States Patent
Kasai

(10) Patent No.: US 7,148,884 B2
(45) Date of Patent: Dec. 12, 2006

(54) SYSTEM AND METHOD OF DRIVING ELECTRO-OPTICAL DEVICE

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 414 days.

(21) Appl. No.: 10/629,585

(22) Filed: Jul. 30, 2003

(65) Prior Publication Data

US 2004/0056252 A1 Mar. 25, 2004

(30) Foreign Application Priority Data

Jul. 31, 2002 (JP) ..... 2002-223162

(51) Int. Cl.
*G09G 5/00* (2006.01)

(52) U.S. Cl. ..... 345/205; 345/211

(58) Field of Classification Search ..... 345/204, 345/205, 211, 212, 690; 315/169.3
See application file for complete search history.

(56) References Cited

U.S. PATENT DOCUMENTS 6,380,689 B1 * 4/2002 Okuda ..... 315/169.3
6,535,185 B1 * 3/2003 Kim et al. ..... 345/76
6,750,833 B1 * 6/2004 Kasai ..... 345/76
6,864,863 B1 * 3/2005 Kasai ..... 345/39
6,876,345 B1 * 4/2005 Akimoto et al. ..... 345/76
2002/0196213 A1 * 12/2002 Akimoto et al. ..... 345/82

* cited by examiner

*Primary Examiner*—Amr A. Awad
*Assistant Examiner*—Tom Sheng
(74) *Attorney, Agent, or Firm*—Oliff & Berridge, PLC

(57) ABSTRACT

The invention provides an electronic circuit, an electronic circuit driving method, an electro-optical device, a method of driving the electro-optical device, and an electronic device which are capable of supplying to a capacitor element a charging voltage for realizing a large range and which are capable of reducing the power consumption of the electronic element. The invention can include a first driving voltage and a second driving voltage Vddb, having different driving voltages, are supplied to the source of a driving transistor. During a data writing period, the driving voltage to be supplied to the driving transistor is made to be the first driving voltage higher than the second driving voltage. During a light-emitting period, the driving voltage to be supplied to the driving transistor is made to be the second driving voltage lower than the first driving voltage.

22 Claims, 8 Drawing Sheets

【Fig. 1】
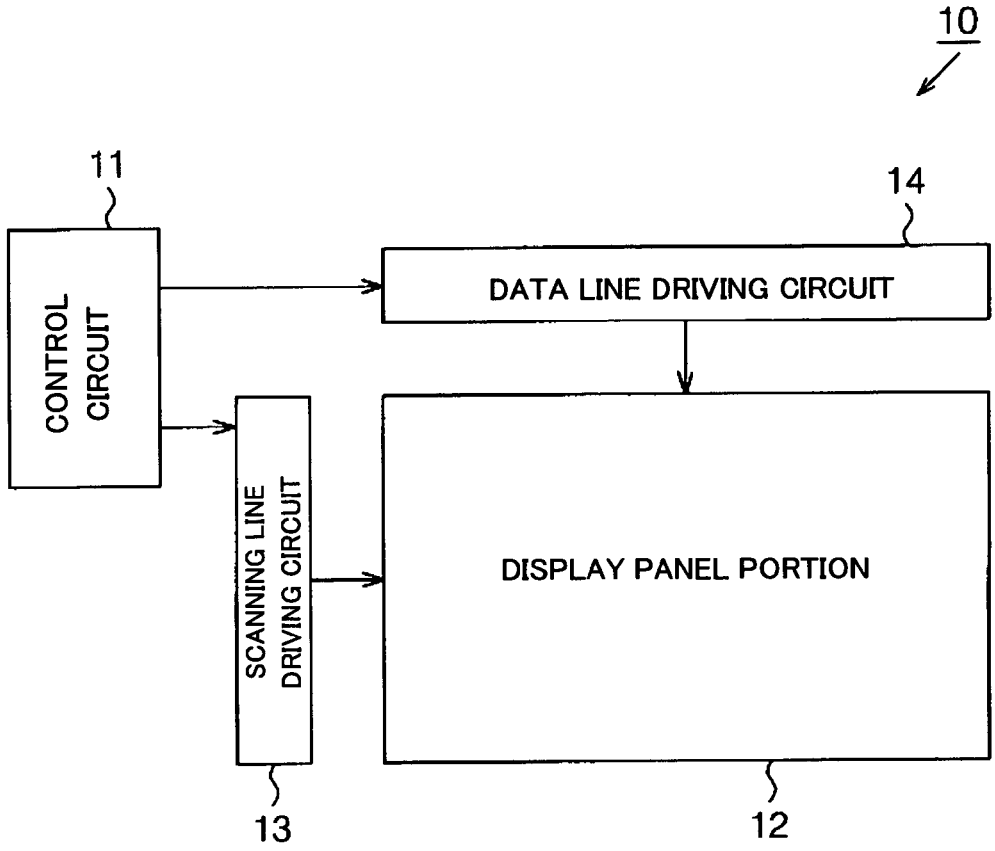

【Fig. 2】
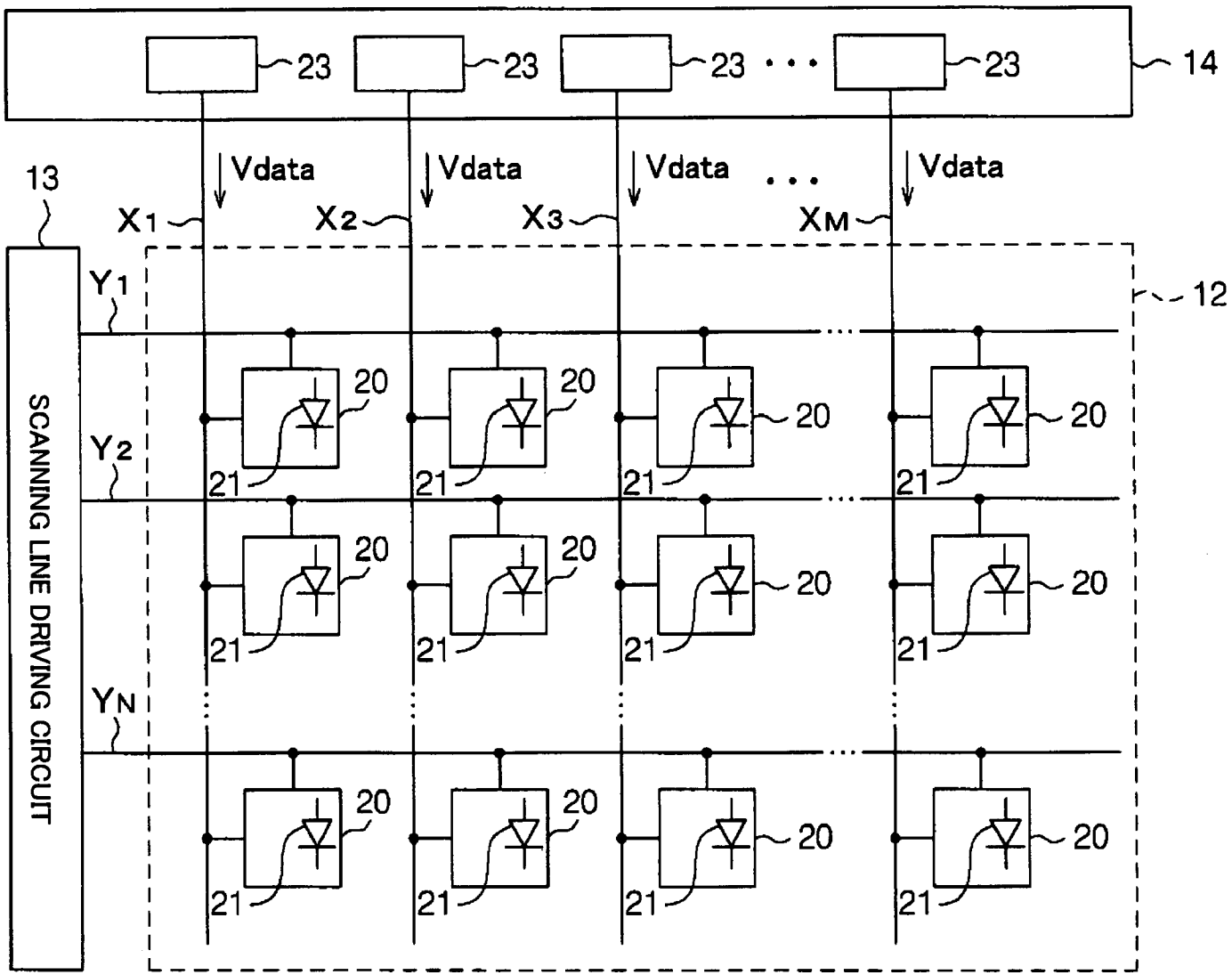

【Fig. 3】
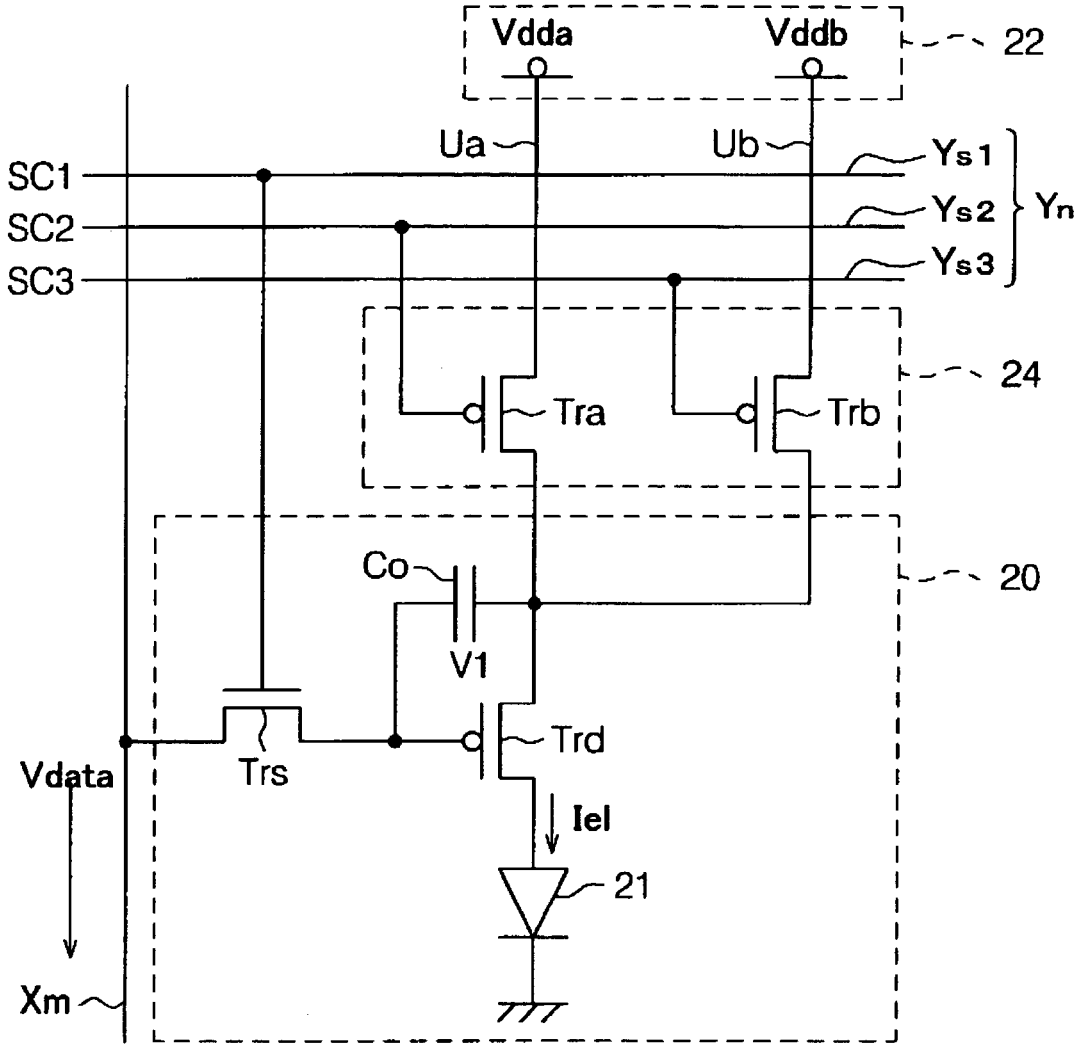
【Fig. 4】
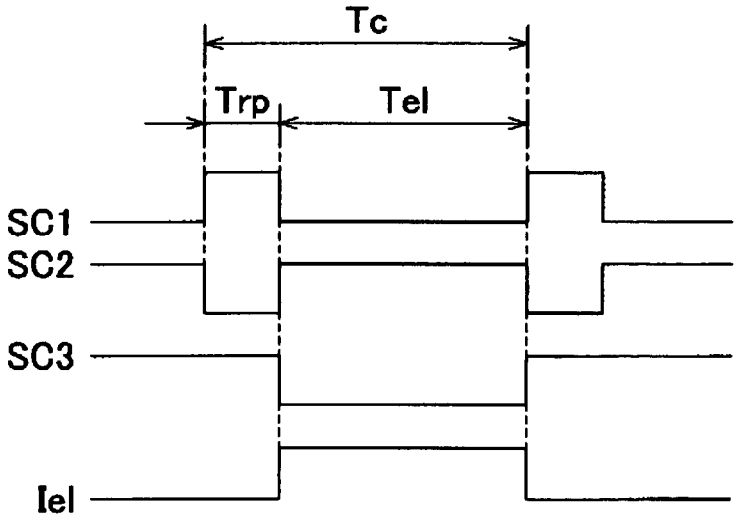

【Fig. 5】
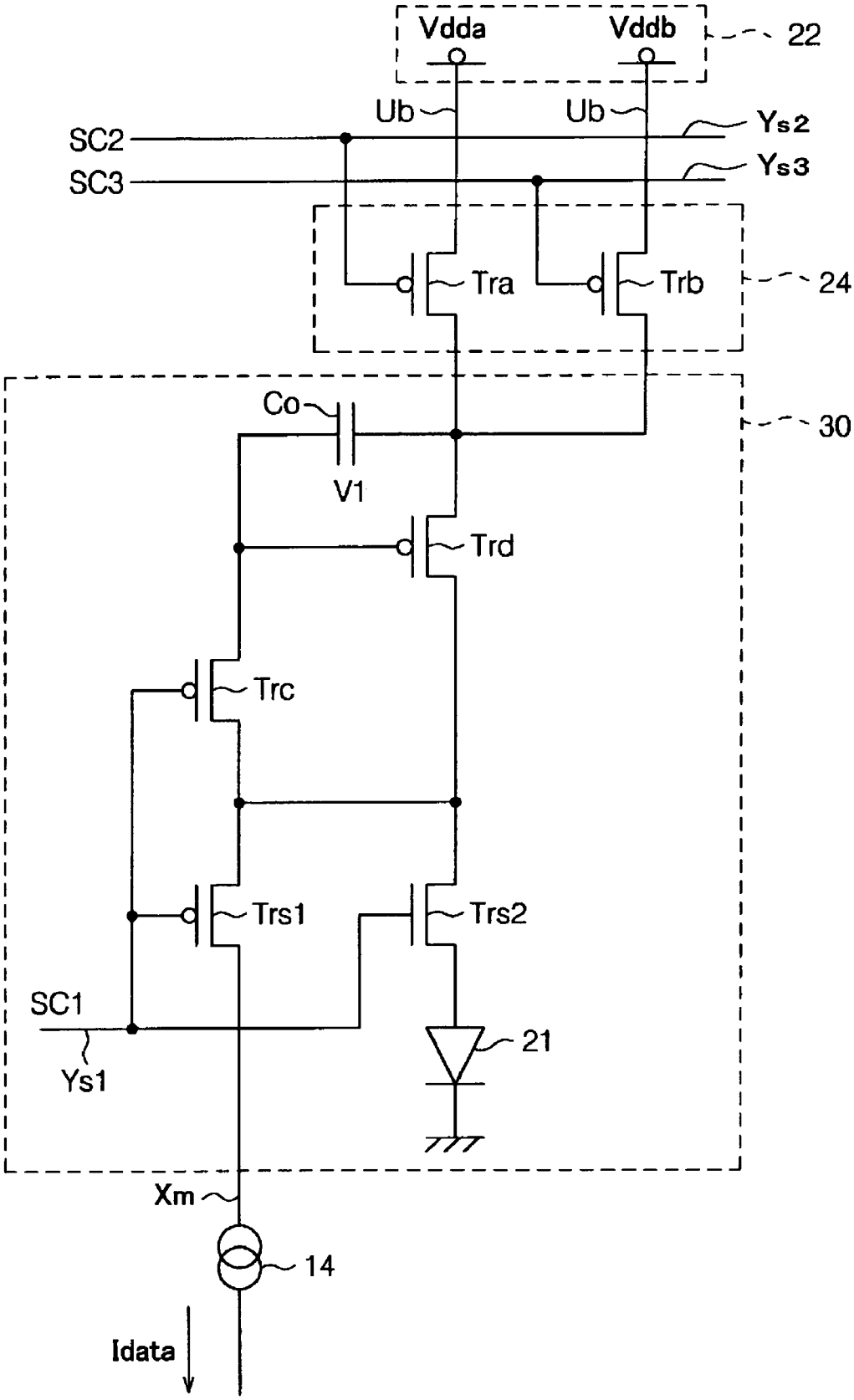

【Fig. 6】
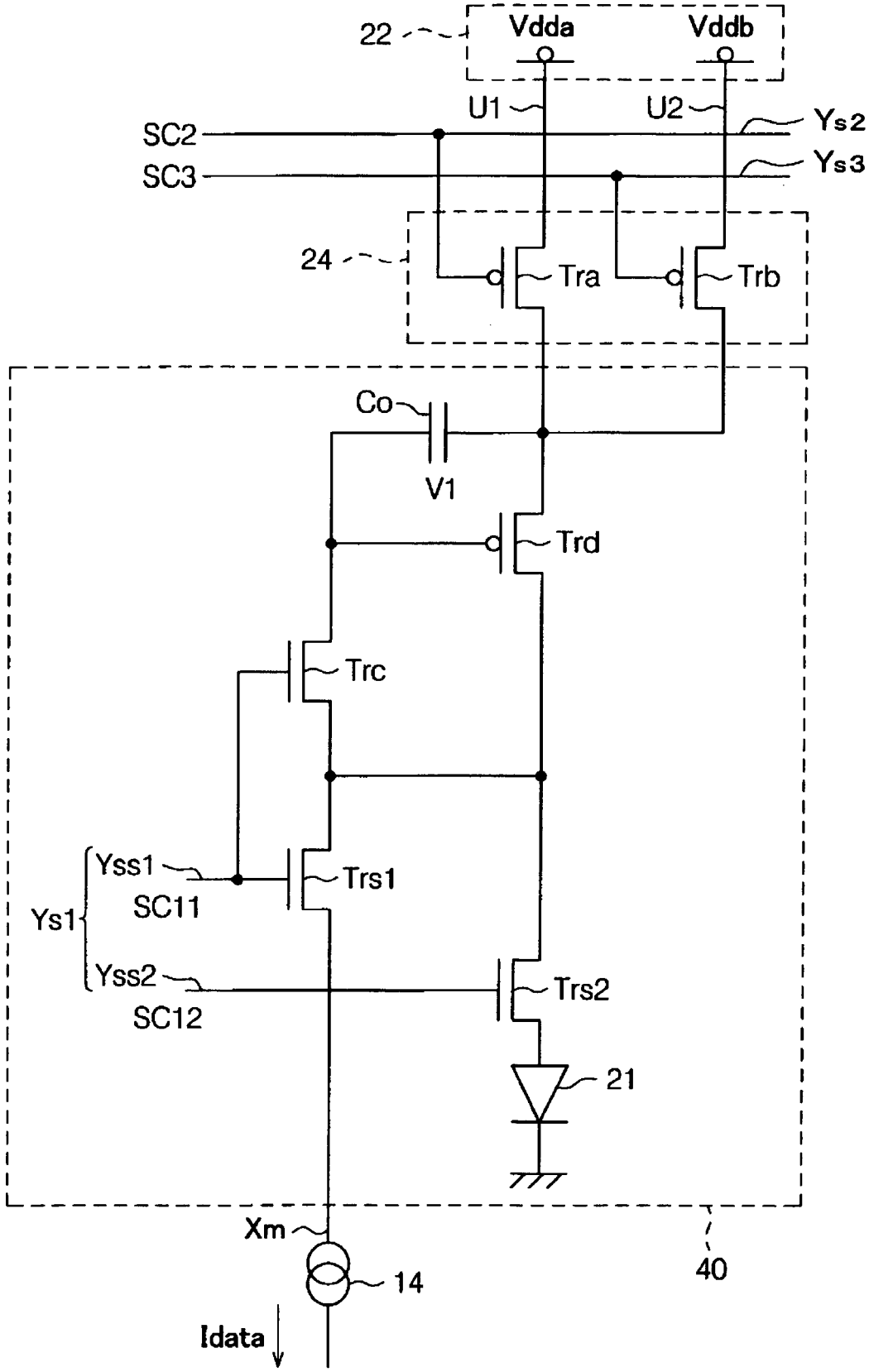

【Fig. 7】
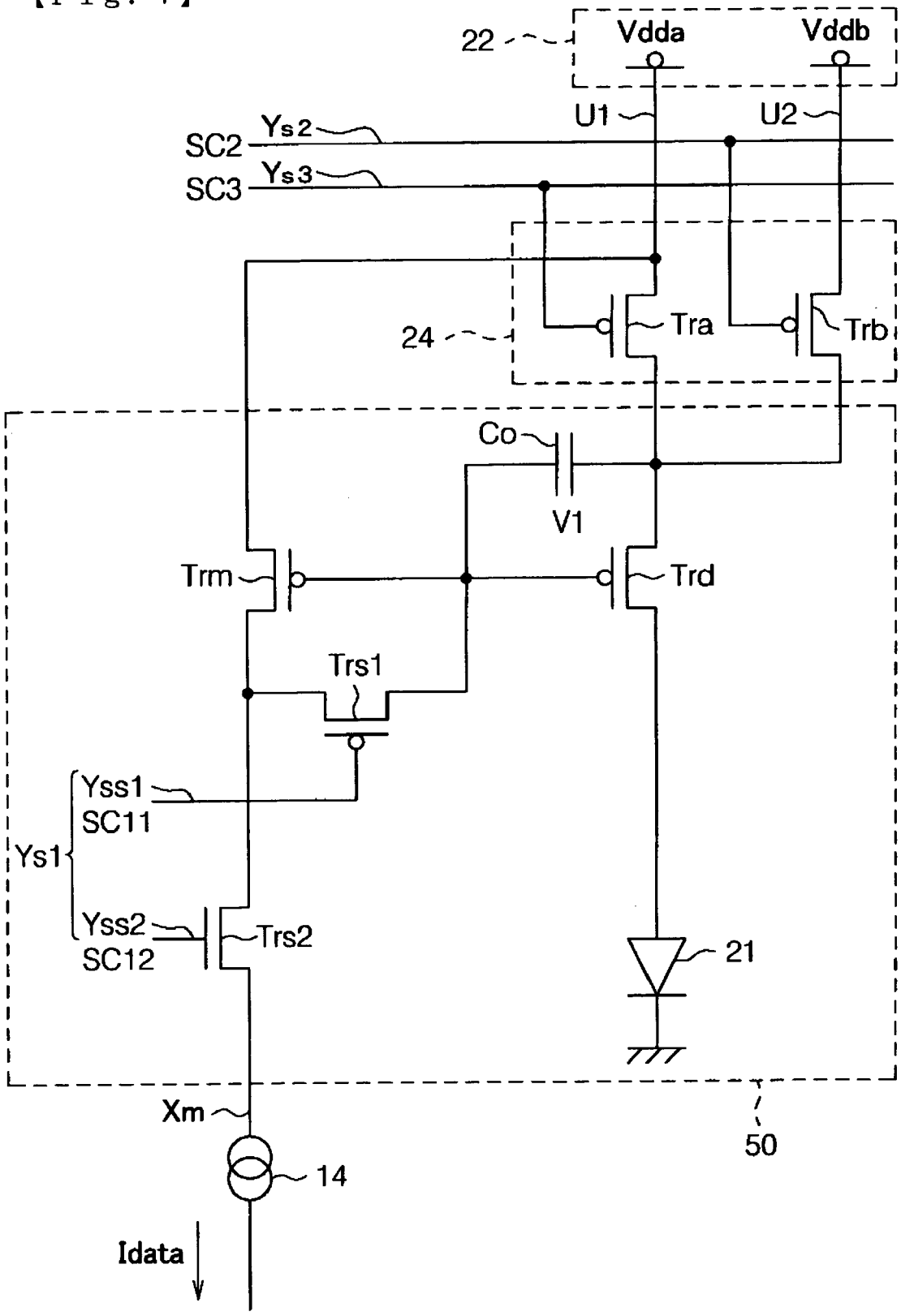

【Fig. 8】
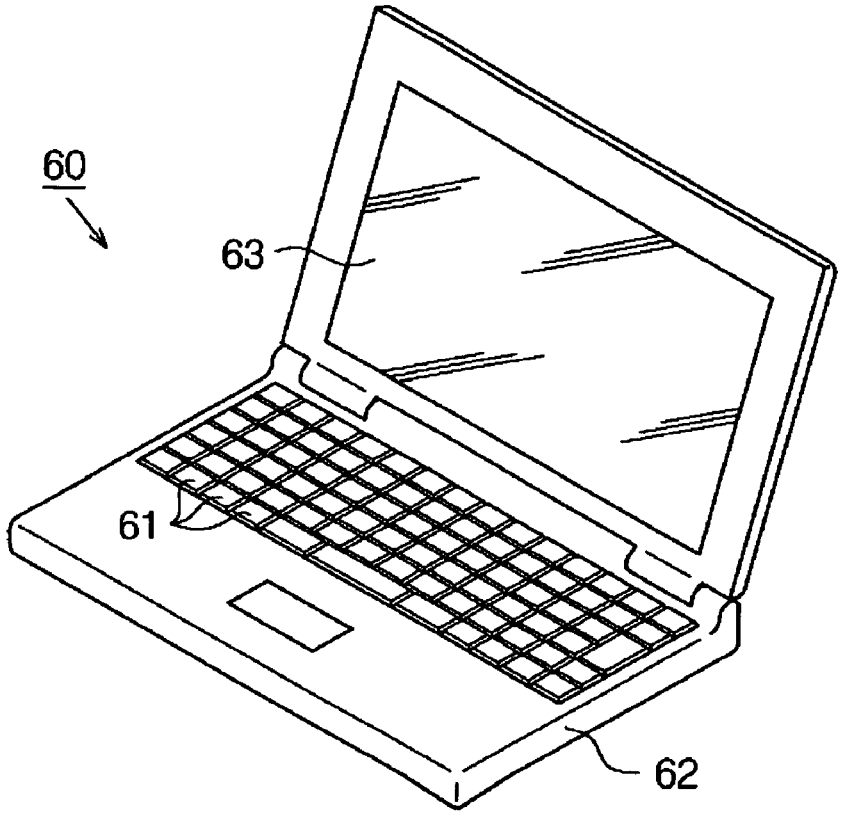
【Fig. 9】
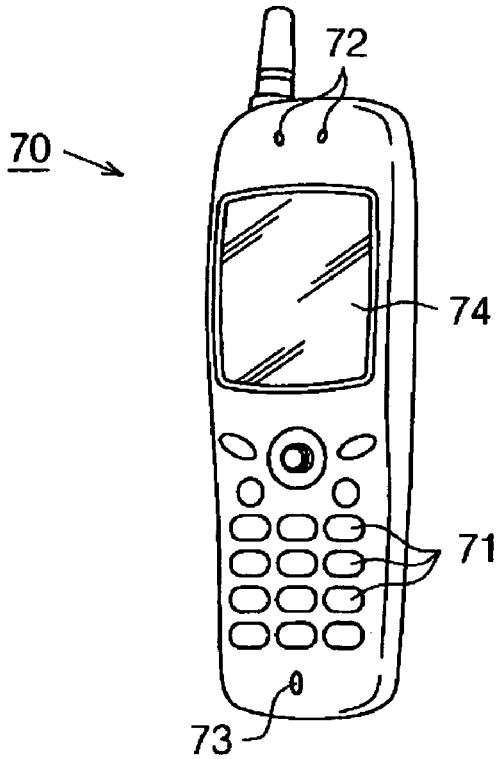

【Fig. 10】
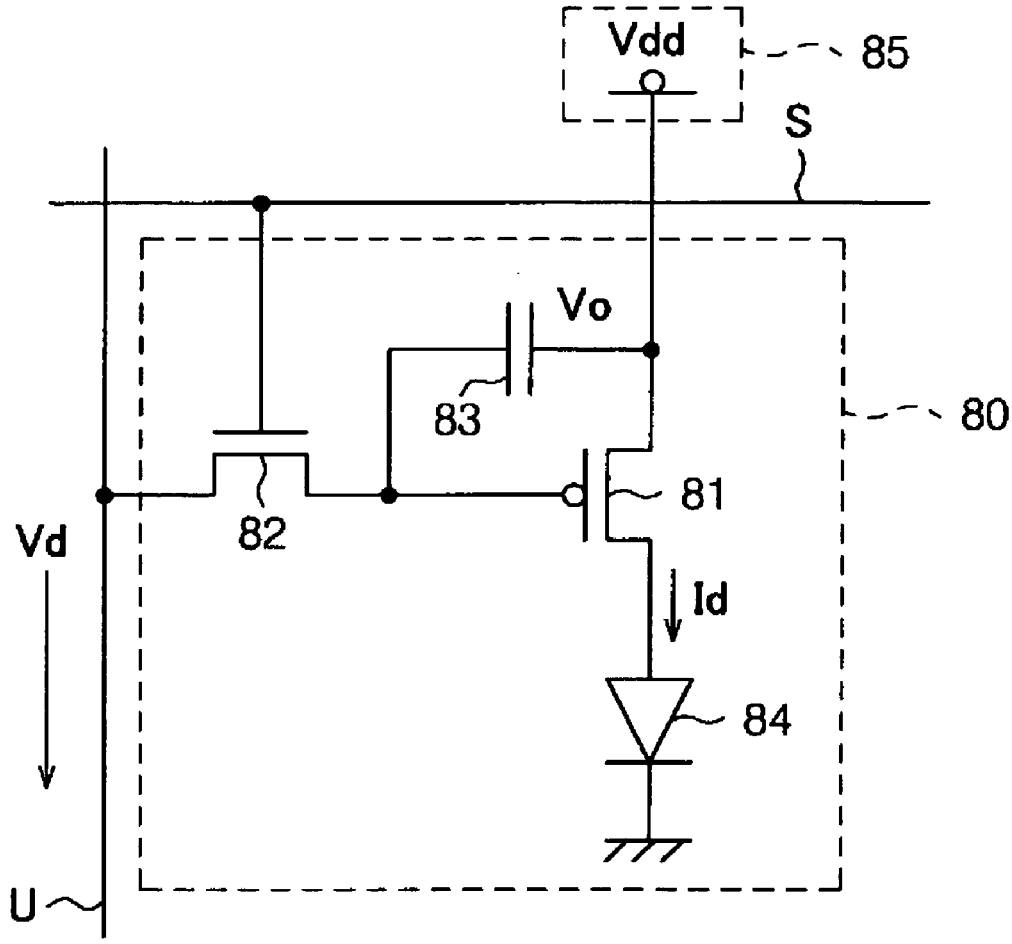

SYSTEM AND METHOD OF DRIVING ELECTRO-OPTICAL DEVICE

BACKGROUND OF THE INVENTION

1. Field of Invention

The present invention relates to an electronic circuit, an electronic circuit driving method, an electro-optical device, a method of driving an electro-optical device, and an electronic device.

2. Description of Related Art

In recent years, electro-optical devices using organic EL elements as current-driven elements have been developed. Since a backlight is not required because organic EL elements are self-luminous elements, it is expected that electro-optical devices having display quality superior to that of other electro-optical devices in power consumption, the viewing angle, contrast, and the like, can be realized.

Among those types of electro-optical device, there is an electro-optical device called an active-matrix type in which pixel circuits for controlling the organic EL elements are arranged in a matrix on the display panel section thereof. The pixel circuits of the active-matrix-type electro-optical device have therein transistors for controlling the organic EL element. When a data signal for causing the display panel section to form a display is supplied from a data-line driving circuit to each pixel circuit, each pixel circuit controls the conductive state of the transistor in accordance with the data signal in order to control the organic EL element.

FIG. 10 is a circuit diagram showing an example of a conventional pixel circuit. A pixel circuit 80 is a pixel circuit of a voltage program method in which the data signal is a voltage signal. The pixel circuit 80 is formed of first and second transistors 81 and 82, a capacitor 83, and an organic EL element 84. The first transistor 81 is a p-channel FET, and the second transistor 82 is an n-channel FET.

The first transistor 81 is a transistor for controlling a driving current Id supplied to the organic EL element 84. The source of the first transistor 81 is connected to a driving power-supply section 85 having a driving voltage Vdd. The drain of the first transistor 81 is connected to the organic EL element 84. The gate of the first transistor 81 is connected to the drain of the second transistor 82. The magnitude of the driving voltage Vdd is set in advance in accordance with the range of the luminance gradation of the organic EL element 84.

The second transistor 82 functions as a switching transistor. The source of the second transistor 82 is connected to a data line U. The data line U is connected to the data-line driving circuit for supplying a data voltage Vd, which is the data signal. The gate of the second transistor 82 is connected to a scanning line S. The on/off state of the second transistor 82 is controlled in accordance with a scanning signal supplied from a scanning-line driving circuit via the scanning line S.

The capacitor 83 is connected between the gate and the source of the first transistor 81. The capacitor 83 is electrically connected to the data line U via the second transistor 82. In the capacitor 83, as a result of the second transistor 82 being turned on, an amount of electrical charge corresponding to the data voltage Vd is charged via the data line U.

In the pixel circuit 80 configured in this manner, first, a scanning signal for turning on the second transistor 82 in a predetermined data writing period is supplied to the gate of the second transistor 82 via the scanning line S from the scanning-line driving circuit. At that time, the second transistor 82 is turned on, and an amount of electrical charge corresponding to the data voltage Vd is charged in the capacitor 83 within the data writing period via the data line U. Then, after the data writing period ends, a scanning signal for turning off the second transistor 82 within a predetermined light-emitting period is supplied from the scanning-line driving circuit via the scanning line S to the gate of the second transistor 82. Then, the second transistor 82 is turned off, and the conductive state of the first transistor 81 is controlled on the basis of the charged voltage Vo corresponding to the amount of electrical charge stored in the capacitor 83 of the first transistor 81. Then, in the first transistor 81, a driving current Id corresponding to the charged voltage Vo is generated, and the driving current Id is supplied to the organic EL element 84. As a result, the luminance gradation of the organic EL element 84 is controlled in accordance with the driving current Id.

At this time, the first transistor 81 is set so as to operate in the saturated area. Therefore, the driving current Id of the first transistor 81 in the saturated area is expressed by the following equation:

$$Id=(1/2)\beta o(Vo-Vth)^2$$

where βo is the gain coefficient of the first transistor. When the carrier mobility of the first transistor is denoted as μ, the gate capacitance as A, the channel width as W, and the channel length as L, the gain coefficient βo is a constant expressed as βo=(βAW/L). Vth is the threshold voltage of the first transistor.

That is, the driving current Id is not directly related to the driving voltage Vdd, but is determined by the charged voltage Vo.

The power consumption Po of the organic EL element 84 is given on the basis of the following equation:

$$\begin{aligned} Po &= Id \cdot Vdd \\ &= (1/2)\beta o(Vo - Vth)^2 \cdot Vdd \end{aligned}$$

Therefore, the power consumption Po is determined by the charged voltage Vo stored in the capacitor 83 and the driving voltage Vdd.

SUMMARY OF THE INVENTION

However, in recent years, in electro-optical devices using the organic EL element 84, there has been a demand for improvements in the contrast of the organic EL element 84 as the resolution becomes finer.

In order to improve the contrast of the organic EL element 84, the driving voltage Vdd must be set to be high so as to increase the range of the luminance gradation of the organic EL element 84. As a result, the power consumption Po increases. This becomes conspicuous for, in particular, an electro-optical device having high display quality and an electro-optical device having a large display panel section.

The present invention has been made to solve the above-described problems. An object of the present invention is to provide an electronic circuit, an electronic circuit driving method, an electro-optical device, a method of driving an electro-optical device, and an electronic device which are capable of supplying to a capacitor element a charging voltage for realizing a large range and which are capable of reducing the power consumption of the electronic element.

The present invention provides an electronic circuit including a circuit section having: a first transistor, a capacitor element for storing an electrical signal supplied via the first transistor as an amount of electrical charge, a second transistor whose conductive state is controlled on the basis of the amount of electrical charge stored in the capacitor element, and an electronic element to which electrical current having a current level corresponding to the conductive state is supplied. There are provided first means for supplying a first driving voltage to the circuit section, and second device for supplying a second driving voltage to the circuit section.

According to the above, a driving voltage to be supplied to the circuit section can be supplied by making a distinction between a case in which an amount of electrical charge corresponding to an electrical signal is stored in the capacitor element and a case in which the conductive state of the second transistor is controlled in accordance with the amount of electrical charge stored in the capacitor element.

In this electronic circuit, the first driving voltage is a voltage higher than the second driving voltage. The first device supplies the first driving voltage at least in a period in which the electrical signal is supplied to the capacitor element via the first transistor, and the second means supplies the second driving voltage at least in a period in which the amount of electrical current corresponding to the conductive state is supplied to the electronic element via the second transistor.

According to the above, an amount of electrical charge corresponding to the electrical signal can be supplied at a high speed to the capacitor element, and the power consumption of the electronic element can be reduced.

The present invention provides an electronic circuit which include a plurality of unit circuits each having: a first transistor, a capacitor element for storing an electrical signal supplied via the first transistor as an amount of electrical charge, a second transistor whose conductive state is controlled on the basis of the amount of electrical charge stored in the capacitor element, and an electronic element to which electrical current having a current level corresponding to the conductive state is supplied. Each of the unit circuits can include a: first device, which is connected to the second transistor, for supplying a first driving voltage to the second transistor, and second device, which is connected to the second transistor, for supplying a second driving voltage to the second transistor.

According to the above, it is possible to provide an electronic circuit having a unit circuit which is capable of supplying to the capacitor element an amount of electrical charge corresponding to the electrical signal at a high speed and reducing the power consumption of the electronic element.

The present invention can provide an electronic circuit having a plurality of unit circuits each can include: a first transistor, a capacitor element for storing an electrical signal supplied via the first transistor as an amount of electrical charge, a second transistor whose conductive state is controlled on the basis of the amount of electrical charge stored in the capacitor element, and an electronic element to which electrical current having a current level corresponding to the conductive state is supplied. There can be provided a first device, which is connected commonly to the second transistor of each of the unit circuits, for supplying a first driving voltage to each of the second transistors, and a second device, which is connected commonly to the second transistor of each of the unit circuits, for supplying a second driving voltage to each of the second transistors.

According to the above, it is possible to provide to the unit circuit an electronic circuit which is capable of externally supplying to the capacitor element the amount of electrical charge corresponding to the electrical signal at a high speed while using a conventional unit circuit and which is capable of reducing the power consumption of the electronic element.

In this electronic circuit, the electronic element is a current-driven element.

According to the above, an amount of electrical charge corresponding to an electrical signal can be supplied at a high speed to the capacitor element, and the power consumption of the current-driven element can be reduced.

In this electronic circuit, the current-driven element is an EL element.

According to the above, an amount of electrical charge corresponding to an electrical signal can be supplied at a high speed to the capacitor element, and the power consumption of the EL element can be reduced.

The present invention can provide a method of driving an electronic circuit having a first transistor, a capacitor element for storing an electrical signal supplied via the first transistor as an amount of electrical charge, a second transistor whose conductive state is controlled on the basis of the amount of electrical charge stored in the capacitor element, and an electronic element to which an amount of electrical current corresponding to the conductive state is supplied. The method of driving an electronic circuit can include the steps of supplying a first driving voltage to the electronic circuit in a period in which the electrical signal is supplied to the capacitor element via the first transistor, and supplying a second driving voltage lower than the first driving voltage in a period in which the amount of electrical current corresponding to the conductive state is supplied to the electronic element via the second transistor.

According to the above, an electronic circuit capable of supplying to the capacitor element an amount of electrical charge corresponding to an electrical signal at a high speed and capable of reducing the power consumption of the electronic element can be driven.

In this electronic circuit driving method, the electronic element is a current-driven element.

According to the above, an electronic circuit capable of supplying to the capacitor element an amount of electrical charge corresponding to an electrical signal at a high speed and capable of reducing the power consumption of the current-driven element can be driven.

In this electronic circuit driving method, the current-driven element is an EL element.

According to the above, an electronic circuit capable of supplying to the capacitor element an amount of electrical charge corresponding to an electrical signal at a high speed and capable of reducing the power consumption of the EL element can be driven.

The present invention can provide an electro-optical device having an electronic circuit that can include a first transistor, a capacitor element for storing an electrical signal supplied via the first transistor as an amount of electrical charge, a second transistor whose conductive state is controlled on the basis of the amount of electrical charge stored in the capacitor element, and an electro-optical element to which an amount of electrical current corresponding to the conductive state is supplied. The electronic circuit can include a first device that supplies a first driving voltage to the electronic circuit, and a second device for supplying a second driving voltage to the electronic circuit.

According to the above, it is possible to provide a electro-optical device capable of supplying a driving voltage to be supplied to the circuit section by making a distinction between a case in which an amount of electrical charge corresponding to an electrical signal is stored in the capacitor element and a case in which the conductive state of the second transistor is controlled in accordance with the amount of electrical charge stored in the capacitor element.

In this electro-optical device, the first driving voltage is a voltage higher than the second driving voltage. The first device can supply the first driving voltage at least in a period in which the electrical signal is supplied to the capacitor element via the first transistor, and the second device can supply the second driving voltage at least in a period in which the amount of electrical current corresponding to the conductive state is supplied to the electro-optical element via the second transistor.

According to the above, an amount of electrical charge corresponding to the electrical signal can be supplied at a high speed to the capacitor element, and the power consumption of the electro-optical element can be reduced.

The present invention can provide an electro-optical device having a plurality of unit circuits each can include: a first transistor, a capacitor element for storing an electrical signal supplied via the first transistor as an amount of electrical charge, a second transistor whose conductive state is controlled on the basis of the amount of electrical charge stored in the capacitor element, and an electro-optical element to which electrical current having a current level corresponding to the conductive state is supplied. Each of the unit circuits can include a first device, which is connected to the second transistor, for supplying a first driving voltage to the second transistor, and a second device, which is connected to the second transistor, for supplying a second driving voltage to the second transistor.

According to the above, it is possible to provide an electro-optical device having a unit circuit which is capable of supplying to the capacitor element an amount of electrical charge corresponding to the electrical signal at a high speed and which is capable of reducing the power consumption of the electronic element.

The present invention can provide an electro-optical device having a plurality of unit circuits each can include a first transistor, a capacitor element for storing an electrical signal supplied via the first transistor as an amount of electrical charge, a second transistor whose conductive state is controlled on the basis of the amount of electrical charge stored in the capacitor element, and an electro-optical element to which electrical current having a current level corresponding to the conductive state is supplied. There can be provided a first device, which is connected commonly to the second transistor of each of the unit circuits, for supplying a first driving voltage to each of the second transistor, and a second device, which is connected commonly to the second transistor of each of the unit circuits, for supplying a second driving voltage to each of the second transistors.

According to the above, it is possible to provide to the unit circuit an electro-optical device which is capable of externally supplying to the capacitor element an amount of electrical charge corresponding to the electrical signal at a high speed while using a conventional unit circuit and which is capable of reducing the power consumption of the electronic element.

In this electro-optical device, the electro-optical element is an organic EL element.

According to the above, an amount of electrical charge corresponding to the electrical signal can be supplied at a high speed to the capacitor element, and the power consumption of the organic EL element can be reduced.

The present invention can provide a method of driving an electro-optical device comprising a first transistor, a capacitor element for storing an electrical signal supplied via the first transistor as an amount of electrical charge, a second transistor whose conductive state is controlled on the basis of the amount of electrical charge stored in the capacitor element, and an electro-optical element to which an amount of electrical current corresponding to the conductive state is supplied. The method of driving an electro-optical device can include the steps of supplying a first driving voltage to the electro-optical device in a period in which the electrical signal is supplied to a capacitor element via the first transistor, and supplying a second driving voltage lower than the first driving voltage in a period in which the amount of electrical current corresponding to the conductive state is supplied to the electro-optical element via the second transistor.

According to the above, an electro-optical device capable of supplying to the capacitor element an amount of electrical charge corresponding to an electrical signal at a high speed and capable of reducing the power consumption of the electro-optical element can be driven.

In this method of driving an electro-optical device, the electro-optical element is an organic EL element. According to the above, an electro-optical device capable of supplying to the capacitor element an amount of electrical charge corresponding to an electrical signal at a high speed and capable of reducing the power consumption of the organic EL element can be driven.

The present invention can provide an electronic device having incorporated therein an electronic circuit according to the above. According to the above, it is possible to provide an electronic device which is capable of causing an amount of electrical charge corresponding to an electrical signal to be stored in the capacitor element at a high speed and which is capable of reducing the power consumption of the electronic element.

The present invention provides an electronic device having incorporated therein an electronic circuit according to the above. According to the above, it is possible to provide an electronic device which is capable of causing an amount of electrical charge corresponding to an electrical signal to be stored in the capacitor element at a high speed and which is capable of reducing the power consumption of the electro-optical element.

BRIEF DESCRIPTION OF THE DRAWINGS

The invention will be described with reference to the accompanying drawings, wherein like numerals reference like elements, and wherein:

FIG. 1 is a block circuit diagram showing the circuit configuration of an organic EL display of this embodiment;

FIG. 2 is a block circuit diagram showing the internal circuit configuration of a display panel section and a data-line driving circuit;

FIG. 3 is a circuit diagram of a pixel circuit of this embodiment;

FIG. 4 is a timing chart illustrating the operation of the pixel circuit of this embodiment;

FIG. 5 is a circuit diagram of a pixel circuit, which illustrates a second embodiment;

FIG. 6 is a circuit diagram of a pixel circuit, which illustrates a third embodiment;

FIG. 7 is a circuit diagram of a pixel circuit, which illustrates a fourth embodiment;

FIG. 8 is a perspective view showing the configuration of a mobile personal computer, which illustrates a fifth embodiment;

FIG. 9 is a perspective view showing the configuration of a cellular phone, which illustrates the fifth embodiment; and FIG. 10 is a circuit diagram of a conventional pixel circuit.

DETAILED DESCRIPTION OF PREFERRED EMBODIMENTS

A first embodiment of the present invention will now be described below with reference to FIGS. 1 to 4.

FIG. 1 is an exemplary block circuit diagram showing the circuit configuration of an organic EL display as an electro-optical device. FIG. 2 is an exemplary block circuit diagram showing the internal circuit configuration of a display panel section and a data-line driving circuit. FIG. 3 is an exemplary circuit diagram of a pixel circuit as an electronic circuit. FIG. 4 is a timing chart showing the operation of the pixel circuit.

An organic EL display 10, as shown in FIG. 1, can include a control circuit 11, a display panel section 12 as an electronic circuit, a scanning-line driving circuit 13, and a data-line driving circuit 14. The organic EL display 10 in this embodiment is an organic EL display having a pixel circuit of a voltage program method. The control circuit 11, the scanning-line driving circuit 13, and the data-line driving circuit 14 of the organic EL display 10 may be formed by electronic parts which are independent of each other. For example, each of the control circuit 11, the scanning-line driving circuit 13, and the data-line driving circuit 14 may be formed by a one-chip semiconductor integrated circuit device. Furthermore, all or some of the control circuit 11, the scanning-line driving circuit 13, and the data-line driving circuit 14 may be formed by programmable IC chips, and the functions thereof may be implemented by means of software written into the IC chips.

The control circuit 11 can generate each scanning control signal and data control signal for displaying a desired image on the display panel section 12 on the basis of the image data output from an external device (not shown). Furthermore, the control circuit 11 outputs the scanning control signal to the scanning-line driving circuit 13 and outputs the data control signal to the data-line driving circuit 14.

As shown in FIG. 2, in the display panel section 12, pixel circuits 20, as a plurality of unit circuits, each having an organic EL element 21 as an electronic element or an electro-optical element, in which a light-emitting layer is formed of an organic material, are disposed in matrix. That is, the pixel circuits 20 are disposed at positions corresponding to the intersections of M data lines Xm (m=1 to M; m is an integer) extending along the column direction and N scanning lines Yn (n=1 to N; n is an integer) extending along the row direction. Furthermore, the display panel section 12 is provided with a driving power-supply section 22 for supplying first and second driving voltages Vdda and Vddb (to be described later) (see FIG. 3). The driving power-supply section 22 is connected to a voltage supply circuit section 24 including transistors Tra and Trb for supplying first and second voltages, as first and second devices, via first and second power supply lines Ua and Ub, respectively. The transistors Tra and Trb for supplying first and second voltages, provided in the voltage supply circuit section 24, are connected to the pixel circuit 20 (see FIG. 3). The transistor (to be described later) arranged inside the pixel circuit 20 is usually formed by a TFT (Thin-Film Transistor).

The scanning-line driving circuit 13 selects one scanning line among the N scanning lines Yn provided in the display panel section 12 in accordance with the scanning control signal output from the control circuit 11, and supplies a scanning signal to the selected scanning line.

The data-line driving circuit 14 can include a plurality of single line drivers 23. Each single line driver 23 is connected to the data line Xm provided in the display panel section 12. Each of the single line drivers 23 generates a data voltage Vdata as an electrical signal in accordance with the data control signal output from the control circuit 11. Furthermore, the single line driver 23 supplies the generated data voltage Vdata to each pixel circuit 20 via the data line Xm. In the pixel circuit 20, by setting the internal state of the pixel circuit 20 in accordance with this data voltage Vdata, a driving current Ie1 which flows through each organic EL element 21 is controlled to control the luminance gradation of the organic EL element 21.

The pixel circuit 20 and the voltage supply circuit section 24 of the organic EL display 10 configured in this manner will now be described below with reference to FIG. 3. The circuit configurations of all the pixel circuits 20 are the same, and accordingly, for the sake of description, a description is given of one pixel circuit and one voltage supply circuit section.

The pixel circuit 20 can include a driving transistor Trd as a second transistor, a switching transistor Trs as a first transistor, and a storage capacitor Co as a capacitor element. The driving transistor Trd and the switching transistor Trs are each formed by a p-channel FET.

The voltage supply circuit section 24 can include transistors Tra and Trb for supplying first and second voltages. Each of the transistors Tra and Trb for supplying first and second voltages is formed by a p-channel FET.

The drain of the driving transistor Trd is connected to the anode of the organic EL element 21. The cathode of the organic EL element 21 is grounded. The source of the driving transistor Trd is connected to each of the drains of the transistors for supplying first and second voltages. The source of the transistor Tra for supplying a first voltage is connected to a first power supply line Ua for supplying a first driving voltage Vdda. The gate of the transistor Tra for supplying a first voltage is connected to a second sub-scanning line Ys2. The source of the transistor Trb for supplying a second voltage is connected to a second power supply line Ub for supplying a second driving voltage Vddb. The gate of the transistor Trb for supplying a second voltage is connected to a third sub-scanning line Ys3.

The first driving voltage Vdda is set to be sufficiently high in order to realize a desired contrast by increasing the range in the luminance gradation of the organic EL element 21. The second driving voltage Vddb is set to be lower than the first driving voltage Vdda. When the pixel circuit 20 is during a data writing period Trp, the transistor Tra for supplying a first voltage is turned on, causing the first driving voltage Vdda to be supplied between the source and the drain of the driving transistor Trd. Furthermore, when the pixel circuit 20 is during a light-emitting period Te1, the transistor Trb for supplying a second voltage is turned on, causing the second driving voltage Vddb to be supplied between the source and the drain of the driving transistor Trd. During the data writing period Trp, the driving transistor Trd is set to operate in the saturated area. Here, the data writing period Tip is a period during which the luminance gradation of the organic EL element 21 is set in the pixel circuit 20. The light-emitting period Te1 is a period during which the driving current Ie1 generated in the driving transistor Trd is supplied to the organic EL element 21.

The gate of the driving transistor Trd is connected to the drain of the switching transistor Trs. The source of the switching transistor Trs is connected to the data line Xm for supplying to each pixel circuit 20 the data voltage Vdata generated in the single line driver 23. The gate of the switching transistor Trs is connected to a first sub-scanning line Ys1. The switching transistor Trs is turned on in response to a first scanning signal SC1 for turning on the switching transistor Trs via the first sub-scanning line Ys1 during the data writing period Trp. Furthermore, the switching transistor Trs is turned off in response to the first scanning signal SC1 for turning off the switching transistor Trs via the first sub-scanning line Ys1 during the light-emitting period Te1. The first, second, and third sub-scanning lines Ys1, Ys2, and Ys3 form the scanning line Yn.

The storage capacitor Co is connected between the gate and the source of the driving transistor Trd. The storage capacitor Co is a capacitor for charging an amount of electrical charge corresponding to the data voltage Vdata generated by the single line driver 23 via the data line Xm when the switching transistor Trs is turned on, that is, when the data writing period Trp is reached. Since the electrostatic capacitance of the storage capacitor Co is set to be sufficiently large so that the influence of the parasitic capacitance in the gate of the driving transistor Trd can be ignored, the pixel circuit 20 is able to charge an amount of electrical charge corresponding to the data voltage Vdata of a magnitude corresponding to that which realizes a large range. This makes it possible for the data voltage Vdata to supply a precise driving current Ie1 to the organic EL element 21.

The method of driving the pixel circuit 20 configured as described above will now be described below with reference to FIGS. 3 and 4. FIG. 4 is an exemplary timing chart of each driving state of the switching transistor Trs, the transistor Tra for supplying a first voltage, and the transistor Trb for supplying a second voltage, and the driving current Ie1 flowing through the organic EL element 21. In FIG. 4, Tc and Te1 represent a driving period and a light-emitting period, respectively. The driving period Tc is made up of the data writing period Trp and the light-emitting period Te1. The driving period Tc means a period in which the luminance gradation of the organic EL element 21 is updated each time, and is the same as the so-called scanning period.

In the pixel circuit 20, first, the first scanning signal SC1 for turning on the switching transistor Trs is supplied from the scanning-line driving circuit 13 via the first sub-scanning line Ys1 to the gate of the switching transistor Trs during the data writing period Trp. Furthermore, a second scanning signal SC2 for turning on the transistor Tra for supplying a first voltage is supplied from the scanning-line driving circuit 13 via the second sub-scanning line Ys2, and a third scanning signal SC3 for turning off the transistor Trb for supplying a second voltage is supplied via a third sub-scanning line Ys3.

At that time, the switching transistor Trs is turned on during the data writing period Trp. Furthermore, the transistor Tra for supplying a first voltage is turned on, and the transistor Trb for supplying a second voltage is turned off.

As a result of the above, in the storage capacitor Co, the amount of electrical charge corresponding to the data voltage Vdata generated in the single line driver 23 is stored, and a voltage V1 corresponding to the amount of electrical charge stored is generated in the storage capacitor Co. At this time, since the first driving voltage Vdda is set to be sufficiently high, it is possible to supply to the storage capacitor Co a data voltage Vdata capable of realizing a large range.

Next, after the data writing period Trp ends, the first scanning signal SC1 for turning off the switching transistor Trs is supplied from the scanning-line driving circuit 13 via the first sub-scanning line Ys1 to the gate of the switching transistor Trs during the predetermined light-emitting period Te1. Furthermore, the second scanning signal SC2 for turning off the transistor Tra for supplying a first voltage is supplied from the scanning-line driving circuit 13 via the second sub-scanning line Ys2, and the third scanning signal SC3 for turning on the transistor Trb for supplying a second voltage is supplied via the third sub-scanning line Ys3.

At that time, the switching transistor Trs is turned off during the light-emitting period Te1. Furthermore, the transistor Tra for supplying a first voltage is turned off, and the transistor Trb for supplying a second voltage is turned on.

As a result, the second driving voltage Vddb is supplied between the drain and the source of the driving transistor Trd. Here, when the magnitude of the gate parasitic capacitance of the driving transistor Trd is small to such a degree as to be ignored in comparison with that of the storage capacitor Co, the amount of electrical charge of the storage capacitor Co is maintained in the transition from the period Trp to the period Te1. That is, the voltage between the source and the drain of the driving transistor Trd is kept. Then, the driving current Ie1 corresponding to the voltage V1 corresponding to the amount of electrical charge stored in the storage capacitor Co is generated, and this current is supplied to the organic EL element 21. Therefore, the organic EL element 21 emits light at a luminance gradation corresponding to the data voltage Vdata. At this time, the driving transistor Trd operates in the saturated area, and the driving current Ie1 is expressed by the following equation:

$$Ie1=(1/2)\beta(V1-Vth)^2$$

where β is the gain coefficient of the driving transistor Trd. When the carrier mobility of the driving transistor Trd is denoted as μ, the gate capacitance as A, the channel width as W, and the channel length as L, the gain coefficient β is a constant expressed as β=(μAW/L). Vth is the threshold voltage of the driving transistor Trd.

Then, the power P consumed by the organic EL element 21 is given on the basis of the following equation:

$$\begin{aligned} P &= Ie1 \cdot Vddb \\ &= (1/2)\beta(V1-Vth)^2 \cdot Vddb \end{aligned}$$

Therefore, during the light-emitting period Te1, by supplying the driving current Ie1 to the organic EL element 21 by using the second driving voltage Vddb, which is lower than the first driving voltage Vdda, the power consumption P can be reduced to be lower than the conventional power consumption.

As a result of the above, it is possible to provide the pixel circuit 20 which is capable of supplying to the storage capacitor Co the data voltage Vdata by which a large range can be realized and which is capable of reducing the power consumption P of the organic EL element.

According to the pixel circuit of the above-described embodiment and the method of driving the pixel circuit, the following features can be obtained.

(1) In this embodiment, the first driving voltage Vdda and the second driving voltage Vddb, having different driving voltages, are supplied to the source of the driving transistor Trd. Then, during the data writing period Trp, the first driving voltage Vdda higher than the second driving voltage Vddb is supplied to the driving transistor Trd. That is, the higher the driving voltage supplied to the driving transistor Trd, the larger the range of the voltage V1 corresponding to the amount of electrical charge stored in the storage capacitor Co.

As a result, it is possible to supply to the storage capacitor Co the data voltage Vdata capable of realizing a large range.

During the light-emitting period Te1, the second driving voltage Vddb lower than the first driving voltage Vdda is supplied to the driving transistor Trd. At this time, if the magnitude of the gate parasitic capacitance of the driving transistor Trd is decreased to such a degree as to be ignored in comparison with that of the storage capacitor Co, it is possible to keep the voltage between the source and the gate of the driving transistor Trd in the transition from the period Trp to the period Te1. As a result, the driving current Ie1 flowing when the second driving voltage Vddb is being supplied as a driving voltage becomes of the same magnitude as that of the driving current Ie1 flowing when the first driving voltage Vdda is being supplied as a driving voltage. That is, while the driving voltage is made low, the corresponding driving current Ie1 can be made to flow.

As a result, during the light-emitting period Te1, by supplying the second driving voltage Vddb to the driving transistor Trd, the power P consumed when the organic EL element 21 is made to emit light can be reduced.

(2) In this embodiment, the electrostatic capacitance of the storage capacitor Co is set to be sufficiently large so that the driving current Ie1 is not influenced by the parasitic capacitance of the gate of the driving transistor Trd. This makes it possible to cause the data voltage Vdata to supply a precise driving current Ie1 to the organic EL element 21.

A second embodiment of the present invention will now be described below with reference to FIG. 5. In this embodiment, component members which are the same as those of the above-described first embodiment are given the same reference numerals, and accordingly, detailed descriptions thereof are omitted.

FIG. 5 is an exemplary circuit diagram of a pixel circuit 30 and a voltage supply circuit section 24, which are disposed in the display panel section 12 of the organic EL display 10. The pixel circuit 30 is a pixel circuit of a current program method, in which a data signal is a current signal. The pixel circuit 30 includes a driving transistor Trd, a controlling transistor Trc, and first and second switching transistors Trs1 and Trs2, a storage capacitor Co, and an organic EL element 21.

The driving transistor Trd, the controlling transistor Trc, and the first switching transistor Trs1 are each a p-channel FET.

The source of the first switching transistor Trs1 is connected to each of the drain of the controlling transistor Trc, the drain of the second switching transistor Trs2, and the drain of the driving transistor Trd. The drain of the first switching transistor Trs1 is electrically connected to the data-line driving circuit 14 via the data line Xm. The data-line driving circuit 14 in this embodiment generates a data current Idata in accordance with the data control signal output from the control circuit 11, and supplies the generated data current Idata to each pixel circuit 30.

The source of the controlling transistor Trc is connected to the gate of the driving transistor Trd. The storage capacitor Co is connected between the source and the gate of the driving transistor Trd.

The anode of the organic EL element 21 is connected to the source of the second switching transistor Trs2, and the cathode of the organic EL element 21 is grounded. The gates of the first and second switching transistors Trs1 and Trs2 and the gate of the controlling transistor Trc are commonly connected to the first sub-scanning line Ys1.

In the pixel circuit 30 configured as described above, the source of the driving transistor Trd is connected to each of the drains of the transistors Tra and Trb for supplying first and second voltages. The source of the transistor Tra for supplying a first voltage is connected to the first power supply line Ua for supplying the first driving voltage Vdda. The gate of the transistor Tra for supplying a first voltage is connected to the second sub-scanning line Ys2. The source of the transistor Trb for supplying a second voltage is connected to the second power supply line Ub for supplying the second driving voltage Vddb. The gate of the transistor Trb for supplying a second voltage is connected to the third sub-scanning line Ys3.

The method of driving the pixel circuit 30 configured as described above will now be described below.

In the pixel circuit 30, first, the first scanning signal SC1 for turning on the controlling transistor Trc and the first switching transistor Trs1 (turning off the second switching transistor Trs2) is supplied from the scanning-line driving circuit 13 via the first sub-scanning line Ys1 to each gate of the controlling transistor Trc and the first and second switching transistors Trs1 and Trs2 during the data writing period Trp. Furthermore, the second scanning signal SC2 for turning on the transistor Tra for supplying a first voltage is supplied from the scanning-line driving circuit 13 via the second sub-scanning line Ys2, and the third scanning signal SC3 for turning off the transistor Trb for supplying a second voltage is supplied via the third sub-scanning line Ys3.

At that time, the controlling transistor Trc and the first switching transistor Trs1 are turned on during the data writing period Trp. Furthermore, the transistor Tra for supplying a first voltage is turned on, and the transistor Trb for supplying a second voltage is turned off.

As a result of the above, the amount of electrical charge corresponding to the data current Idata generated in the single line driver 23 is charged in the storage capacitor Co, causing a voltage V1 corresponding to the amount of the stored electrical charge to be generated in the storage capacitor Co. At this time, since the first driving voltage Vdda is set to be sufficiently high, a data current Idata capable of realizing a large range can be supplied to the storage capacitor Co.

Next, after the data writing period Trp ends, the first scanning signal SC1 for turning off the controlling transistor Trc and the first switching transistor Trs1 (turning on the second switching transistor Trs2) during the predetermined light-emitting period Te1 is supplied from the scanning-line driving circuit 13 via the first sub-scanning line Ys1 to the gate of the switching transistor Trs. Furthermore, the second scanning signal SC2 for turning off the transistor Tra for supplying a first voltage is supplied from the scanning-line driving circuit 13 via the second sub-scanning line Ys2, and the third scanning signal SC3 for turning on the transistor Trb for supplying a second voltage is supplied via the third sub-scanning line Ys3.

At that time, the controlling transistor Trc and the first switching transistor Trs1 are turned off during the light-emitting period Te1. Furthermore, the transistor Tra for supplying a first voltage is turned off, and the transistor Trb for supplying a second voltage is turned on.

As a result of the above, the second driving voltage Vddb is supplied between the drain and the source of the driving transistor Trd. Here, when the magnitude of the gate parasitic capacitance of the driving transistor Trd is small to such a degree as to be ignorable in comparison with that of the storage capacitor Co, the amount of electrical charge of the storage capacitor Co is maintained in the transition from the period Trp to the period Te1. That is, the voltage between the source and the gate of the driving transistor Trd is kept. At that time, the driving current Ie1 corresponding to the voltage V1 corresponding to the amount of the charged electrical charge in the storage capacitor Co is generated, and this current is supplied to the organic EL element 21. Therefore, the organic EL element 21 emits light at a luminance gradation corresponding to the data current Idata. That is, during the light-emitting period Te1, by supplying the driving current Ie1 to the organic EL element 21 by using the second driving voltage Vddb, which is lower than the first driving voltage Vdda, the power consumption P can be reduced to be lower than the conventional power consumption.

Therefore, also, in the pixel circuit 30 of a current program method, in which a data signal is a current signal, the same advantages as those of the first embodiment can be obtained.

A third embodiment of the present invention will now be described below with reference to FIG. 6. In this embodiment, component members which are the same as those of the above-described first embodiment are given the same reference numerals, and accordingly, detailed descriptions thereof are omitted.

FIG. 6 is an exemplary circuit diagram of a pixel circuit 40 and a voltage supply circuit section 24, which are disposed in the display panel section 12 of the organic EL display 10. The pixel circuit 40 is a pixel circuit of a current program method, in which a data signal is a current signal. The pixel circuit 40 includes a driving transistor Trd, a controlling transistor Trc, first and second switching transistors Trs1 and Trs2, a storage capacitor Co, and an organic EL element 21.

The driving transistor Trd is a p-channel FET. The controlling transistor Trc and the first and second switching transistors Trs1 and Trs2 are each an n-channel FET.

The drain of the first switching transistor Trs1 is connected to each of the source of the controlling transistor Trc, the drain of the second switching transistor Trs2, and the drain of the driving transistor Trd. The source of the first switching transistor Trs1 is connected to the data-line driving circuit 14 via the data line Xm. The data-line driving circuit 14 in this embodiment generates a data current Idata in accordance with the data control signal output from the control circuit 11 and supplies the generated data current Idata to each pixel circuit 30.

The drain of the controlling transistor Trc is connected to the gate of the driving transistor Trd. The storage capacitor Co is connected between the source and the gate of the driving transistor Trd.

The anode of the organic EL element 21 is connected to the source of the second switching transistor Trs2, and the cathode of the organic EL element 21 is grounded. The gate of the first switching transistor Trs1 and the gate of the controlling transistor Trc are commonly connected to a first scanning control line Yss1. The gate of the second switching transistor Trs2 is connected to a second scanning control line Yss2. The first scanning control line Yss1 and the second scanning control line Yss2 form a first sub-scanning line Ys1.

In the pixel circuit 40 configured as described above, the source of the driving transistor Trd is connected to each of the drains of the transistors Tra and Trb for supplying first and second voltages. The source of the transistor Tra for supplying a first voltage is connected to a first power supply line Ua for supplying a first driving voltage Vdda. The gate of the transistor Tra for supplying a first voltage is connected to a second sub-scanning line Ys2. The source of the transistor Trb for supplying a second voltage is connected to a second power supply line Ub for supplying a second driving voltage Vddb. The gate of the transistor Trb for supplying a second voltage is connected to a third sub-scanning line Ys3.

The method of driving the pixel circuit 40 configured as described above will now be described below. In the pixel circuit 40, during the data writing period Trp, a first scanning control signal SC11 for turning on the controlling transistor Trc and the first switching transistor Trs1 is supplied to the gates of the controlling transistor Trc and the first switching transistor Trs1 from the scanning-line driving circuit 13 via the first scanning control line Yss1 forming the first sub-scanning line Ys1. At this time, during the data writing period Trp, a second sub-scanning signal SC12 for turning off the second switching transistor Trs2 is supplied to the gate of the second switching transistor Trs2 from the scanning-line driving circuit 13 via the second scanning control line Yss2 forming the first sub-scanning line Ys1.

Furthermore, the second scanning signal SC2 for turning on the transistor Tra for supplying a first voltage is supplied from the scanning-line driving circuit 13 via the second sub-scanning line Ys2, and the third scanning signal SC3 for turning off the transistor Trb for supplying a second voltage is supplied via the third sub-scanning line Ys3.

At that time, the controlling transistor Trc and the first switching transistor Trs1 are turned on during the data writing period Trp, and the second switching transistor Trs2 is turned off during the data writing period Trp. Furthermore, at this time, the transistor Tra for supplying a first voltage is turned on, and the transistor Trb for supplying a second voltage is turned off.

As a result of the above, in the storage capacitor Co, the amount of electrical charge corresponding to the data current Idata generated in the single line driver 23 is charged, causing a voltage V1 corresponding to the stored electrical charge to be generated in the storage capacitor Co. At this time, since the first driving voltage Vdda is set to be sufficiently high, it is possible to supply to the storage capacitor Co a data current Idata capable of realizing a large range.

Next, after the data writing period Trp ends, during the predetermined light-emitting period Te1, the first scanning control signal SC11 for turning off the controlling transistor Trc and the first switching transistor Trs1 is supplied to the gates of the controlling transistor Trc and the first switching transistor Trs1 from the scanning-line driving circuit 13 via the first scanning control line Yss1. At this time, during the light-emitting period Te1, the second sub-scanning signal SC12 for turning on the second switching transistor Trs2 is supplied to the gate of the second switching transistor Trs2 from the scanning-line driving circuit 13 via the scanning control line Yss2.

At this time, the second scanning signal SC2 for turning off the transistor Tra for supplying a first voltage is supplied from the scanning-line driving circuit 13 via the second sub-scanning line Ys2, and the third scanning signal SC3 for turning on the transistor Trb for supplying a second voltage is supplied via the third sub-scanning line Ys3.

At that time, the controlling transistor Trc and the first switching transistor Trs1 are turned off during the light-emitting period Te1. Furthermore, the transistor Tra for supplying a first voltage is turned off, and the transistor Trb for supplying a second voltage is turned on.

As a result of the above, the second driving voltage Vddb is supplied between the drain and the source of the driving transistor Trd. Here, when the magnitude of the gate parasitic capacitance of the driving transistor Trd is small to such a degree as to be ignorable in comparison with that of the storage capacitor Co, the amount of electrical charge of the storage capacitor Co is maintained in the transition from the period Trp to the period Te1. That is, the voltage between the source and the gate of the driving transistor Trd is kept. At that time, the driving current Ie1 corresponding to the voltage V1 corresponding to the amount of electrical charge stored in the storage capacitor Co is generated, and this current is supplied to the organic EL element 21. Therefore, the organic EL element 21 emits light at a luminance gradation corresponding to the data current Idata.

More specifically, during the light-emitting period Te1, by supplying the driving current Ie1 to the organic EL element 21 by using the second driving voltage Vddb which is lower than the first driving voltage Vdda, the power consumption P can be reduced to be lower than the conventional power consumption. Accordingly, in the pixel circuit 40 of the current program method, in which a data signal is a current signal, the same advantages as those of the first embodiment can be obtained.

A fourth embodiment of the present invention will now be described below with reference to FIG. 7. In this embodiment, component members which are the same as those of the above-described first embodiment are given the same reference numerals, and accordingly, detailed descriptions thereof are omitted.

FIG. 7 is an exemplary circuit diagram of a pixel circuit 50 and a voltage supply circuit section 24 of the organic EL display 10. The pixel circuit 50 is a pixel circuit of a current program method, in which a data signal is a current signal. The pixel circuit 50 includes a driving transistor Trd, a transistor Trm, first and second switching transistors Trs1 and Trs2, a storage capacitor Co, and an organic EL element 21.

The driving transistor Trd, the transistor Trm, and the first switching transistor Trs1 are each a p-channel FET. The second switching transistor Trs2 is an n-channel FET.

The first switching transistor Trs1 is connected between the gate and the drain of the transistor Trm. The source of the transistor Trm is connected to the drain of the transistor Tra for supplying a first voltage. That is, the transistor Trm together with the driving transistor Trd forms a current-mirror circuit. The gate of the transistor Trm is connected to the gate of the driving transistor Trd.

The storage capacitor Co is connected between the source and the gate of the driving transistor Trd. The source of the second switching transistor Trs2 is connected to the data-line driving circuit 14 via the data line Xm.

The anode of the organic EL element 21 is connected to the drain of the driving transistor Trd, and the cathode of the organic EL element 21 is grounded.

The gate of the first switching transistor Trs1 is commonly connected to the first scanning control line Yss1. The gate of the second switching transistor Trs2 is connected to the second scanning control line Yss2. The first scanning control line Yss1 and the second scanning control line Yss2 form the first sub-scanning line Ys1.

In the pixel circuit 50 configured as described above, the source of the driving transistor Trd is connected to each of the drains of the transistors Tra and Trb for supplying first and second voltages. The source of the transistor Tra for supplying a first voltage is connected to the first power supply line Ua for supplying the first driving voltage Vdda. The gate of the transistor Tra for supplying a first voltage is connected to the second sub-scanning line Ys2. The source of the transistor Trb for supplying a second voltage is connected to the second power supply line Ub for supplying the second driving voltage Vddb. The gate of the transistor Trb for supplying a second voltage is connected to the third sub-scanning line Ys3.

The method of driving the pixel circuit 50 configured as described above will now be described below. In the pixel circuit 50, during the data writing period Trp, the first scanning control signal SC1 for turning on the first switching transistor Trs1 is supplied from the scanning-line driving circuit 13 to the gate of the first switching transistor Trs1 via the first scanning control line Yss1 forming the first sub-scanning line Ys1.

At this time, during the data writing period Trp, the second sub-scanning signal SC12 for turning on the second switching transistor Trs2 is supplied from the scanning-line driving circuit 13 to the gate of the second switching transistor Trs2 via the second scanning control line Yss2 forming the first sub-scanning line Ys1.

Furthermore, the second scanning signal SC2 for turning on the transistor Tra for supplying a first voltage is supplied from the scanning-line driving circuit 13 via the second sub-scanning line Ys2, and the third scanning signal SC3 for turning off the transistor Trb for supplying a second voltage is supplied via the third sub-scanning line Ys3.

At that time, the first and second switching transistors Trs1 and Trs2 are turned on during the data writing period Trp. Furthermore, the transistor Tra for supplying a first voltage is turned on, and the transistor Trb for supplying a second voltage is turned off.

As a result of the above, in the storage capacitor Co, an amount of electrical charge corresponding to the data current Idata generated in the single line driver 23 is charged, causing a voltage V1 corresponding to the amount of the stored electrical charge to be generated in the storage capacitor Co. At this time, since the first driving voltage Vdda is set to be sufficiently high, it is possible to supply to the storage capacitor Co the data current Idata capable of realizing a large range.

Next, after the data writing period Trp ends, during the predetermined light-emitting period Te1, the first scanning control signal SC11 for turning off the first switching transistor Trs1 is supplied to the gate of the first switching transistor Trs1 from the scanning-line driving circuit 13 via the first scanning control line Yss1 1. At this time, during the light-emitting period Te1, the second sub-scanning signal SC12 for turning off the second switching transistor Trs2 is supplied to the gate of the second switching transistor Trs2 from the scanning-line driving circuit 13 via the second scanning control line Yss2.

At this time, the second scanning signal SC2 for turning off the transistor Tra for supplying a first voltage is supplied from the scanning-line driving circuit 13 via the second sub-scanning line Ys2, and the third scanning signal SC3 for turning on the transistor Trb for supplying a second voltage is supplied via the third sub-scanning line Ys3.

At that time, the first and second switching transistors Trs1 and Trs2 are turned off during the light-emitting period Te1. Furthermore, the transistor Tra for supplying a first voltage is turned off, and the transistor Trb for supplying a second voltage is turned on.

As a result of the above, the second driving voltage Vddb is supplied between the drain and the source of the driving transistor Trd. Here, when the magnitude of the gate parasitic capacitance of the driving transistor Trd is small to such a degree as to be ignorable in comparison with that of the storage capacitor Co, the amount of electrical charge of the storage capacitor Co is maintained in the transition from the period Trp to the period Te1. That is, the voltage between the source and gate of the driving transistor Trd is kept. At that time, the driving current Ie1 corresponding to the voltage V1 corresponding to the amount of electrical charge stored in the storage capacitor Co is generated, and this current is supplied to the organic EL element 21. Therefore, the organic EL element 21 emits light at a luminance gradation corresponding to the data current Idata. That is, during the light-emitting period Te1, by supplying the driving current Ie1 to the organic EL element 21 by using the second driving voltage Vddb which is be lower than the first driving voltage Vdda, the power consumption P can be reduced to lower than the conventional power consumption.

Accordingly, in the pixel circuit 50 of a current program method, in which a data signal is a current signal, the same advantages as those of the first embodiment can be obtained.

Applications of the electronic device of the organic EL display 10 as an electro-optical device described in the first to fourth embodiments will now be described below with reference to FIGS. 8 and 9. The organic EL display 10 can be applied to various electronic devices such as a mobile personal computer, a cellular phone, and a digital camera.

FIG. 8 shows a perspective view showing the configuration of a mobile personal computer. In FIG. 8, a personal computer 60 includes a main unit section 62 including a keyboard 61, and a display unit 63 using the organic EL display 10.

Also, in this case, the display unit 63 using the organic EL display 10 exhibits advantages similar to those of the above-described embodiments. As a result, it is possible to provide the mobile personal computer 60 including the low-power-consumption pixel circuit 20, 30, 40, or 50.

FIG. 9 shows a perspective view showing the configuration of a cellular phone. In FIG. 9, a cellular phone 70 includes a plurality of operation buttons 71, a earpiece 72, a mouthpiece 73, and a display unit 74 using the organic EL display 10. Also, in this case, the display unit 74 using the organic EL display 10 exhibits advantages similar to those of the above-described embodiments. As a result, it is possible to provide the cellular phone 70 including the low-power-consumption pixel circuit 20, 30, 40, or 50.

It should be understood that the embodiments of the present invention are not limited to the above-described embodiments, and may be embodied as described below.

In the above-described embodiments, as the current-driven element, the organic EL element 21 is used. However, instead, another current-driven element may be used. For example, a current-driven element such as a light-emitting element such as an LED and an FED may be used.

In the above-described embodiments, as the electro-optical device, the organic EL display 10 using the pixel circuits 20, 30, 40, and 50 having the organic EL element 21 is used. However, instead, a display using a pixel circuit having an inorganic EL element in which a light-emitting layer is made of an inorganic material may be used.

In the above-described embodiments, the organic EL display 10 provided with the pixel circuits 20, 30, 40, and 50 of the organic EL element 21, which is formed of one color, is used. However, an EL display provided with the pixel circuits 20, 30, 40, and 50 for each color with respect to the organic EL element 21 of the three colors of red, green, and blue may be used.

According to the invention as set forth above, a charging voltage for realizing a large range can be supplied to a capacitor element, and the power consumption of an electronic element can be reduced.

While this invention has been described in conjunction with specific embodiments thereof, it is evident that many alternatives, modifications, and variations will be apparent to those skilled in the art. Accordingly, preferred embodiments of the invention as set forth herein are intended to be illustrative, not limiting. Various changes may be made without departing from the spirit and scope of the invention.

What is claimed is:

1. An electronic circuit having a circuit section, comprising:

a first transistor;

a capacitor element that stores an electrical signal supplied by said first transistor as an amount of electrical charge;

a second transistor having a conductive state that is controlled on the basis of the amount of electrical charge stored in said capacitor element; and an electronic element to which an electrical current having a current level corresponding to said conductive state is supplied, wherein there are provided a first device that supplies a first driving voltage to said circuit section, the first device being a first switching element; and a second device that supplies a second driving voltage to said circuit section, the second device being a second switching element, the first driving voltage and the second driving voltage being supplied to one electrode of the capacitor element, said first driving voltage being higher than said second driving voltage, said first device supplying said first driving voltage at least in a period in which the electrical signal is supplied to the capacitor element by said first transistor, and said second device supplying said second driving voltage at least in a period in which the amount of electrical current corresponding to the conductive state is supplied to said electronic element via said second transistor.

2. An electronic circuit according to claim 1, said electronic element being a current-driven element.

3. An electronic circuit according to claim 2, said current-driven element being an EL element.

4. An electronic device having incorporated therein the electronic circuit according to claim 1.

5. An electronic circuit having a plurality of unit circuits, each comprising:

a first transistor;

a capacitor element that stores an electrical signal supplied by said first transistor as an amount of electrical charge;

a second transistor having conductive state that is controlled on the basis of the amount of electrical charge stored in said capacitor element; and an electronic element to which an electrical current having a current level corresponding to said conductive state is supplied, wherein each of said unit circuits comprises:

a first device, which is connected to said second transistor, that supplies a first driving voltage to the second transistor, the first device being a first switching element; and a second device, which is connected to said second transistor, that supplies a second driving voltage to the second transistor, the second device being a second switching element, the first driving voltage and the second driving voltage being supplied to one electrode of the capacitor element, said first driving voltage being higher than said second driving voltage, said first device supplying said first driving voltage at least in a period in which the electrical signal is supplied to the capacitor element by said first transistor, and said second device supplying said second driving voltage at least in a period in which the amount of electrical current corresponding to the conductive state is supplied to said electronic element via said second transistor.

6. An electronic circuit according claim 5, said electronic element being a current-driven element.

7. An electronic circuit according to claim 6, said current-driven element being an EL element.

8. An electronic circuit having a plurality of unit circuits, each comprising:

a first transistor;

a capacitor element that stores an electrical signal supplied by said first transistor as an amount of electrical charge;

a second transistor having conductive state that is controlled on the basis of the amount of electrical charge stored in said capacitor element; and an electronic element to which an electrical current having a current level corresponding to said conductive state is supplied, wherein there are provided a first device, which is connected commonly to said second transistor of each of said unit circuits, that supplies a first driving voltage to each of said second transistors, the first device being a first switching element; and a second device, which is connected commonly to said second transistor of each of said unit circuits, that supplies a second driving voltage to the second transistor, the second device being a second switching element, the first driving voltage and the second driving voltage being supplied to one electrode of the capacitor element, said first driving voltage being higher than said second driving voltage, said first device supplying said first driving voltage at least in a period in which the electrical signal is supplied to the capacitor element by said first transistor, and said second device supplying said second driving voltage at least in a period in which the amount of electrical current corresponding to the conductive state is supplied to said electronic element via said second transistor.

9. An electronic circuit according claim 8, said electronic element being a current-driven element.

10. An electronic circuit according to claim 9, said current-driven element being an EL element.

11. A method of driving an electronic circuit having a first transistor, a capacitor element that stores an electrical signal supplied by said first transistor as an amount of electrical charge, a second transistor having a conductive state that is controlled on the basis of the amount of electrical charge stored in said capacitor element, and an electronic element to which an amount of electrical current corresponding to said conductive state is supplied, said method of driving an electronic circuit comprising:

supplying, via a first device a first driving voltage to said electronic circuit in a period in which the electrical signal is supplied to the capacitor element via said first transistor; and supplying, via a second device a second driving voltage, which is lower than said first driving voltage, in a period in which the amount of electrical current corresponding to the conductive state is supplied to said electronic element via said second transistor, the first driving voltage and the second driving voltage being supplied to one electrode of the capacitor element.

12. A method of driving an electronic circuit according to claim 11, said electronic element being a current-driven element.

13. A method of driving an electronic circuit according to claim 12, said current-driven element being an EL element.

14. An electro-optical device having an electronic circuit, comprising:

a first transistor;

a capacitor element that stores an electrical signal supplied by said first transistor as an amount of electrical charge;

a second transistor having a conductive state is that controlled on the basis of the amount of electrical charge stored in said capacitor element; and an electro-optical element to which an amount of electrical current corresponding to said conductive state is supplied, said electronic circuit comprising:

a first device that supplies a first driving voltage to said electronic circuit, the first device being a first switching element; and a second device that supplies a second driving voltage to said electronic circuit, the second device being a second switching element, the first driving voltage and the second driving voltage being supplied to one electrode of the capacitor element, said first driving voltage being a voltage higher than said second driving voltage, said first device supplying said first driving voltage at least in a period in which the electrical signal is supplied to the capacitor element by said first transistor, and said second device supplying said second driving voltage at least in a period in which the amount of electrical current corresponding to the conductive state is supplied to said electro-optical element via said second transistor.

15. An electro-optical device according to claim 14, said electro-optical element being an organic EL element.

16. An electronic device having incorporated therein the electro-optical device according to claim 14.

17. An electro-optical device having a plurality of unit circuits, each comprising:

a first transistor;

a capacitor element that stores an electrical signal supplied by said first transistor as an amount of electrical charge;

a second transistor having a conductive state that is controlled on the basis of the amount of electrical charge stored in said capacitor element; and an electro-optical element to which electrical current having a current level corresponding to said conductive state is supplied, each of said unit circuits comprising:

a first device, which is connected to said second transistor, that supplies a first driving voltage to the second transistor, the first device being a first switching element; and a second device, which is connected to said second transistor, that supplies a second driving voltage to the second transistor, the second device being a second switching element, the first driving voltage and the second driving voltage being supplied to one electrode of the capacitor element, said first driving voltage being higher than said second driving voltage, said first device supplying said first driving voltage at least in a period in which the electrical signal is supplied to the capacitor element by said first transistor, and said second device supplying said second driving voltage at least in a period in which the amount of electrical current corresponding to the conductive state is supplied to said electro-optical element via said second transistor.

18. An electro-optical device according to claim 17, said electro-optical element being an organic EL element.

19. An electro-optical device having a plurality of unit circuits, each comprising:

a first transistor;

a capacitor element that stores an electrical signal supplied by said first transistor as an amount of electrical charge;

a second transistor having a conductive state that is controlled on the basis of the amount of electrical charge stored in said capacitor element; and an electro-optical element to which electrical current having a current level corresponding to said conductive state is supplied, wherein there are provided a first device, which is connected commonly to said second transistor of each of said unit circuits, that supplies a first driving voltage to each of said second transistors, the first device being a first switching element; and a second device, which is connected commonly to said second transistor of each of said unit circuits, that supplies a second driving voltage to each of the second transistors, the second device being a second switching element, the first driving voltage and the second driving voltage being supplied to one electrode of the capacitor element, said first driving voltage being higher than said second driving voltage, said first device supplying said first driving voltage at least in a period in which the electrical signal is supplied to the capacitor element by said first transistor, and said second device supplying said second driving voltage at least in a period in which the amount of electrical current corresponding to the conductive state is supplied to said electro-optical element via said second transistor.

20. An electro-optical device according to claim 19, said electro-optical element being an organic EL element.

21. A method of driving an electro-optical device comprising a first transistor, a capacitor element for storing an electrical signal supplied via said first transistor as an amount of electrical charge, a second transistor whose conductive state is controlled on the basis of the amount of electrical charge stored in said capacitor element, and an electro-optical element to which an amount of electrical current corresponding to said conductive state is supplied, said method of driving an electro-optical device comprising the steps of: supplying, via a first device a first driving voltage to said electro-optical device in a period in which the electrical signal is supplied to the capacitor element via said first transistor; and supplying, via a second device a second driving voltage lower than said first driving voltage in a period in which the amount of electrical current corresponding to the conductive state is supplied to said electro-optical element via said second transistor, the first driving voltage and the second driving voltage being supplied to one electrode of the capacitor element.

22. A method of driving an electro-optical device according to claim 21, wherein said electro-optical element is an organic EL element.

* * * * *